US006747219B1

(12) United States Patent
Brauburger

(10) Patent No.: US 6,747,219 B1
(45) Date of Patent: Jun. 8, 2004

(54) CONTRACTOR ARRANGEMENT WITH A BLOCKING ELEMENT

(75) Inventor: Oliver Brauburger, Wöllstadt (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/089,150

(22) PCT Filed: Sep. 21, 2000

(86) PCT No.: PCT/DE00/03296

§ 371 (c)(1),
(2), (4) Date: Mar. 27, 2002

(87) PCT Pub. No.: WO01/24213

PCT Pub. Date: Apr. 5, 2001

(30) Foreign Application Priority Data

Sep. 27, 1999 (DE) ..... 199 46 207

(51) Int. Cl.[7] ..... H01H 13/72
(52) U.S. Cl. ..... 200/50.36; 200/552
(58) Field of Search ..... 200/552, 50.36, 200/50.3

(56) References Cited

U.S. PATENT DOCUMENTS 3,370,481 A * 2/1968 Mekelburg et al. ..... 200/552 X
4,539,860 A * 9/1985 Johnston et al. ..... 200/50.36 X
5,646,382 A * 7/1997 Moriya ..... 200/50.36 X

FOREIGN PATENT DOCUMENTS

| | | |
|---|---|---|
| DE | 24 40 361 B2 | 3/1976 |
| DE | 195 48 480 C1 | 5/1997 |
| DE | 297 06 431 U1 | 7/1997 |
| EP | 0 313 954 A1 | 5/1989 |
| EP | 0 455 534 A1 | 11/1991 |

* cited by examiner

*Primary Examiner*—Renee Luebke
(74) *Attorney, Agent, or Firm*—Harness, Dickey & Pierce, P.L.C.

(57) ABSTRACT

Two contactors are mutually interlocked via a blocking element which is arranged between the contactors. The blocking element interacts with guides on the contact supports of the contactors. The guides act directly on the blocking element. Only compression forces, but no tensile forces or shear forces, now occur in the blocking element, as a result of this and as a result of the blocking element being configured in a suitable manner.

19 Claims, 3 Drawing Sheets

CONTRACTOR ARRANGEMENT WITH A BLOCKING ELEMENT

This application is the national phase under 35 U.S.C. § 371 of PCT International Application No. PCT/DE00/03296 which has an International filing date of Sep. 21, 2000, which designated the United States of America, the entire contents of which are hereby incorporated by reference.

1. Field of the Invention

The present invention generally relates to a contactor arrangement having two contactors and a blocking element. In one aspect, the contactors include guides for contact supports, with a blocking element being deflected from an intermediate position to a blocking position by the guide of the operated contactor when one of the contactors is operated. The blocking position may prevent operation of the unoperated contactor. Further, the guide of the unoperated contactor may act in an operating region on the blocking element if an attempt is made to operate the unoperated contactor. In addition, the guides may act directly on the blocking element.

2. Background of the Invention

Contactor arrangements are known, for example, from DE 195 48 480 C1 or DE 24 40 361 A1.

EP 0 313 954 A1 discloses a contactor arrangement having two contactors and a blocking element. The contactors have guides for contact supports. The blocking element is deflected from an intermediate position to a blocking position by the guide of the operated contactor when one of the contactors is operated. The blocking position prevents operation of the unoperated contactor. The guide of the unoperated contactor acts in an operating region on the blocking element if an attempt is made to operate the unoperated contactor. The guides act directly on the blocking element via pins.

Electrical loads are often connected to a supply network in different ways. One example of such types of connection is the optional connection of a load in star or delta to a three-phase network or to a reversing circuit, in which either the polarity of the DC voltage is reversed or a three-phase network is connected to a load alternatively with a positive phase sequence and a negative phase sequence.

The electrical load is generally connected to the supply network via contactors. If both contactors were operated at the same time, this would result in a short between the phases. Such simultaneous operation of both contactors must therefore be prevented. In known arrangements, this is achieved by the contactor arrangements that have been mentioned.

It repeated attempts are made to operate the unoperated contactor, fatigue occurs over the course of time in the blocking elements mentioned previously. Finally, they break, so that they can no longer carry out their function.

In the contactor arrangement according to EP 0 313 954 A1, the blocking element is coupled to the movement of the contact supports via pins, which are inserted at the side into the contact support guide. The movement of the contact supports is thus transmitted to the blocking element via the pins. When the blocking element is in the blocking position, then the movement of the contact support is blocked via the pin. This likewise prevents the unoperated contactor from being operated. In practice, it has been found that the high forces that occur result in the pins breaking off. The pins thus represent a weakness in this contactor arrangement.

SUMMARY OF THE INVENTION

An object of an embodiment of the present invention is to provide a contactor arrangement in which the guides act directly on the blocking element, and in which no fatigue nevertheless occurs in the blocking element.

Such an object may be achieved wherein essentially only compression forces occur in the blocking element as a result of any attempt to operate it.

An embodiment of the invention is based on the knowledge that fatigue in the blocking elements or the pins is caused by tensile and/or bending stresses. If the stress is essentially purely compressive, on the other hand, virtually no material fatigue occurs.

An essentially purely compressive stress can be produced particularly easily if, when an attempt to operate it is made, the blocking element is pressed underneath the operating region against at least one stop, so that the blocking element is supported on the at least one stop during the attempt to operate it.

If, in addition, essentially only compression forces occur, in the guide of the unoperated contactor when an attempt is made to operate it, virtually no material fatigue occurs in the guide of the unoperated contactor, either.

The contactor arrangement has a particularly simple design if side surfaces of the contactors face one another, the blocking element is arranged in a blocking element holder, and the blocking element holder is arranged between the contactors.

The creation of essentially only compression forces in the guide of the unoperated contactor can be achieved, in design terms, particularly easily if the blocking element can pivot in a pivoting plane which runs at right angles to the side surfaces.

The mechanical design becomes even simpler if the guides act on the blocking element in an operating direction, and the operating direction runs parallel to the side surfaces.

If the blocking element holder is arranged at least partially i in the contactors, the contactor arrangement occupies only a small amount of space. The occupied space is a minimum when the side surfaces are adjacent to one another.

If the contactors each have one front face and one rear face, which is opposite the front face, and the rear faces and the blocking element holder end flush with one another, this necessarily results in the blocking element being positioned in a defined manner. There is no longer any need for adjustments.

If the blocking element is in the form of a rotating cardioid, the blocking element operates particularly reliably.

In principle, the contactors may be of any desired configuration. Generally, however, at least three load contacts can respectively be operated via the contact supports.

BRIEF DESCRIPTION OF THE DRAWINGS

Further advantages and details result from the following description of an exemplary embodiment. In this case, illustrated in outline form, the drawings include.

DETAILED DESCRIPTION OF THE PREFERRED EMBODIMENTS

Figure 1:
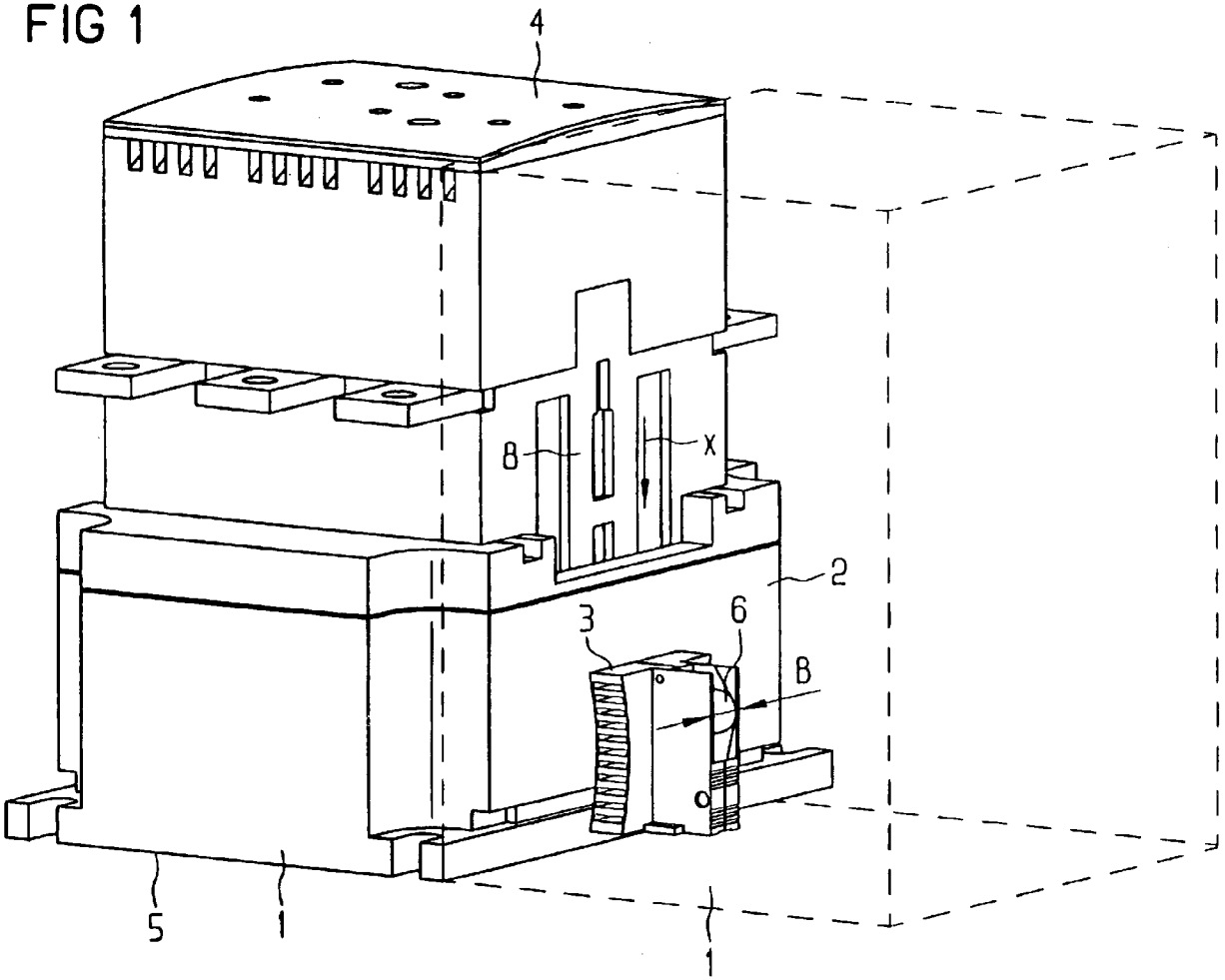
FIG. 1 shows a contactor arrangement.

FIG. 1 shows two contactors 1. One of the contactors 1 is shown in detail in this case, while the other contactor 1 is illustrated only schematically. The contactors 1 have side surfaces 2 which face one another, and a blocking element holder 3 is arranged between the contactors.

It is possible to arrange the contactors 1 at a distance from one another. However, preferably the side surfaces 2 are adjacent to one another. In this case in particular, the blocking element holder 3 is arranged completely or partially recessed in the contactors 1. The contactors 1 each have one front face 4 and one rear face 5, which is opposite the front face 4. The rear faces 5 and the blocking element holder 3 end flush with one another.

The blocking element holder 3 has an unobstructed accommodation width B. A blocking element 6 is arranged in the blocking element holder 3 and has a blocking element width b, which is slightly smaller than the unobstructed accommodation width B.

Figure 2:
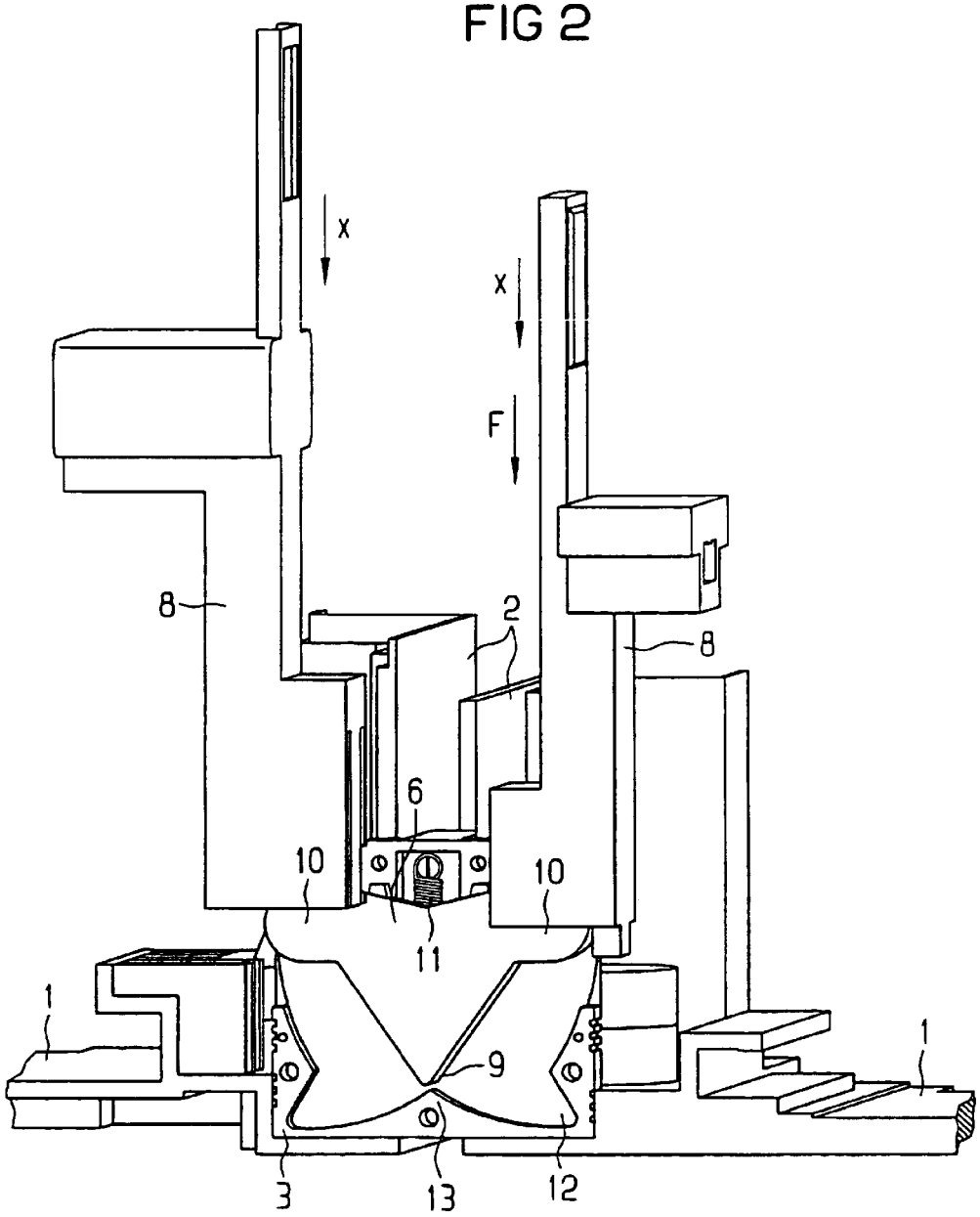
FIG. 2 shows a detail from FIG. 1, in the form of a section.
Figure 3:
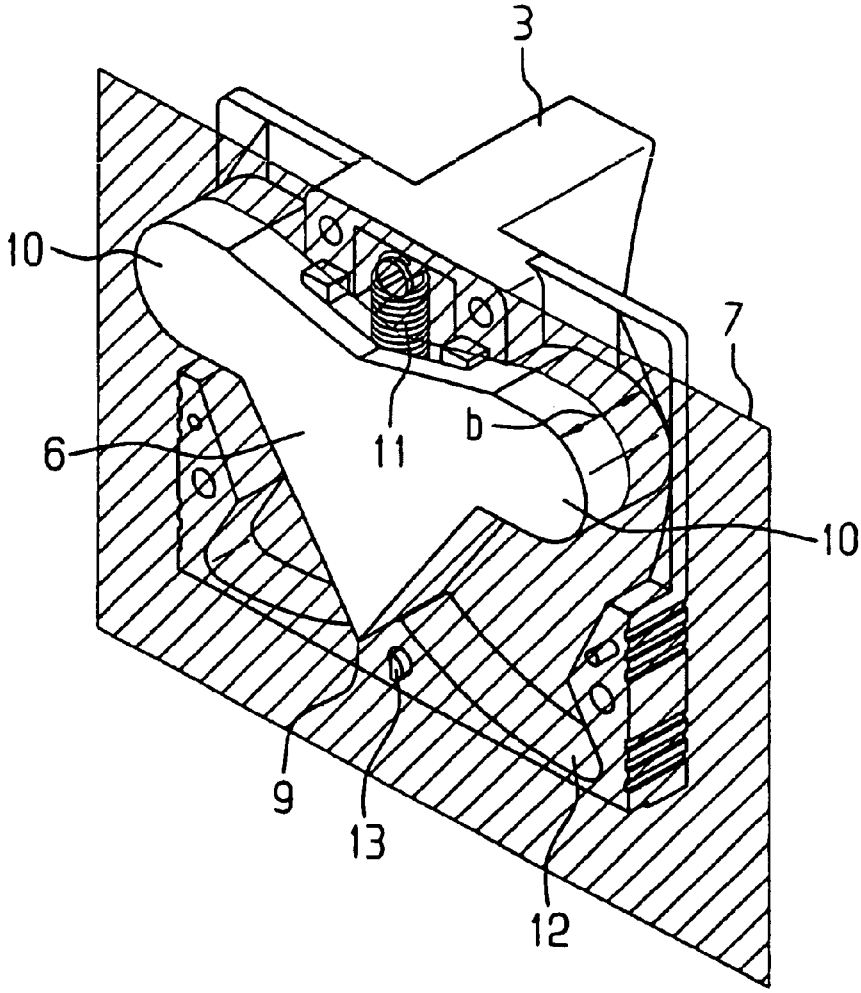
FIG. 3 shows a blocking element in a blocking element holder, in the form of a section.

As can be seen from FIGS. 2 and 3, the blocking element is held in the blocking element holder 3 such that it can pivot in a pivoting plane 7. The accommodation width B extends at right angles to this pivoting plane 7. The side surfaces 2 and the pivoting plane 7 are at right angles to one another.

The contactors 1 have guides 8 for contact supports. At least one load contact can be operated by each of the contact supports. Preferably, even at least three load contacts can be operated via the contact supports. This makes it possible to connect a three-phase network to a load.

The blocking element 6 shown in FIGS. 2 and 3 is in the form of a so-called rotating cardioid 6 which has a cardioid tip 9 and operating regions 10. If neither contactor 1 is operated, the rotating cardioid 6 is held by a resetting spring 11 in an intermediate position, which is illustrated in FIGS. 2 and 3. By way of example, it is assumed in the following text that the left-hand one of the two contactors 1 is now operated first of all, and an attempt is then made to operate the right hand one of the two contactors 1, as well.

The operation of the left-hand contactor 1 results in its guide 8 being moved in an operating direction x. The operating direction x runs parallel to the side surfaces 2 and parallel to the pivoting plane 7. The operation of the left-hand guide 8 results in the cardioid tip 9 of the blocking element 6 being deflected into a holding chamber 12, which is essentially arranged underneath the guide 8 of the right-hand contactor 1. In this position, the blocking element 6 is located in a blocking position, in which it is impossible to operate the right-hand contactor 1. The guide 8 in this case acts directly on the blocking element 6 in the operating region 10, which is located within the blocking element width b and hence, in particular, also within the accommodation width B.

If an attempt is now made to operate the right-hand contactor 1 as well, its guide 8 is likewise deflected in the operating direction x. The guide 8 of the right-hand contactor 1 in this case acts directly on the blocking element 6 in the corresponding operating region 10, which is likewise located within the blocking element width b, and is hence also within the accommodation width B. In consequence, the blocking element 6 is pressed against the blocking element holder 3 in the region of the holding chamber. 12 and in a central region 13. It is thus supported against the blocking element holder 3 in the region of the holding chamber 12 and the central region 13. This prevents any further movement of the right-hand guide 8, and hence prevents operation of the right-hand contactor 1. The lower face of the holding chamber 12 and the central region 13 thus represent stops 12, 13 arranged underneath the operating region 10.

The guide 8 of the right-hand contactor 1 exerts an operating force F in the operating direction x onto the blocking element 6 when an attempt is made to operate it. However, since it acts within the accommodation width B, the operating force F acts directly on the blocking element holder 3, that is to say, in particular, without any deflection and hence without any shear forces occurring. Essentially only compression forces, but no tensile forces or shear forces, thus occur, to be precise both in the guides 8 and in the blocking element 6.

As already mentioned, the contactors 1 may have any desired configuration. In particular, they may be either in the form of air contactors or vacuum contactors. A combination of an air contactor and a vacuum contactor is also possible.

The invention being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A contactor arrangement, comprising:

two contactors; and a blocking element, wherein the contactors include guides, wherein the blocking element is in an intermediate position, permitting operation of either contactor, when none of the contactors are operated, wherein the blocking element is deflected from the intermediate position to a blocking position blocking operation of one of the two contactors thereby creating a blocked contactor, by a guide of an operated contactor upon one of the contactors being operated, the blocking position preventing operation of the blocked contactor, wherein the guide of the blocked contactor acts in an operating region on the blocking element upon attempting to operate the blocked contactor, wherein the guides act directly on the blocking element, wherein essentially only compression forces occur in the blocking element as a result of an attempt to operate the blocked contactor, wherein side surfaces of the contactors face one another, wherein the blocking element is arranged in a blocking element holder, wherein the blocking element holder is arranged between the contactors and wherein the blocking element holder is arranged at least partially recessed in the contactors.

2. The contactor arrangement as claimed in claim 1, wherein, when an attempt is made to operate the blocked contactor, the blocking element is pressed underneath the operating region against at least one stop, such that the blocking element is supported on the at least one stop during the operating attempt.

3. The contactor arrangement as claimed in claim 2, wherein, when an attempt is made to operate it, essentially only compression forces also occur in the guide of the blocked contactor.

4. The contactor arrangement as claimed in claim 2, wherein side surfaces of the contactors face one another, wherein the blocking element is arranged in a blocking element holder, and wherein the blocking element holder is arranged between the contactors.

5. The contactor arrangement as claimed in claim 1, wherein, when an attempt is made to operate the blocked contactor, essentially only compression forces also occur in the guide of the blocked contactor.

6. The contactor arrangement as claimed in claim 5, wherein side surfaces of the contactors face one another, wherein the blocking element is arranged in a blocking element holder, and wherein the blocking element holder is arranged between the contactors.

7. The contactor arrangement as claimed in claim 1, wherein the blocking element is pivotable in a pivoting plane which runs at right angles to the side surfaces.

8. The contactor arrangement as claimed in claim 7, wherein the guides act on the blocking element in an operating direction, and wherein the operating direction runs parallel to the side surfaces.

9. The contactor arrangement as claimed in claim 7, wherein the contactors each include one front face and one rear face, opposite the front face, and wherein the rear faces and the blocking element holder end flush with one another.

10. The contactor arrangement as claimed in claim 7, wherein the blocking element holder is arranged at least partially recessed in the contactors.

11. The contactor arrangement as claimed in claim 10, wherein the side surfaces are adjacent to one another.

12. The contactor arrangement as claimed in claim 1, wherein the guides act on the blocking element in an operating direction, and wherein the operating direction runs parallel to the side surfaces.

13. The contactor arrangement as claimed in claim 1, wherein the side surfaces are adjacent to one another.

14. The contactor arrangement as in claim 1, wherein the blocking element is in the form of a rotating cardioid.

15. The contactor arrangement as claimed in claim 14, wherein at least three load contacts can respectively be operated via the contact supports.

16. A contactor arrangement, comprising:

two contactors; and a blocking element, wherein the contactors include guides, wherein the blocking element is in an intermediate position, permitting operation of either contactor, when none of the contactors are operated, wherein the blocking element is deflected from the intermediate position to a blocking position blocking operation of one of the two contactors thereby creating a blocked contactor, by a guide of an operated contactor upon one of the contactors being operated, the blocking position preventing operation of the blocked contactor, wherein the guide of the blocked contactor acts in an operating region on the blocking element upon attempting to operate the blocked contactor, wherein the guides act directly on the blocking element, wherein essentially only compression forces occur in the blocking element as a result of an attempt to operate the blocked contactor, wherein side surfaces of the contactors face one another, wherein the blocking element is arranged in a blocking element holder, wherein the blocking element holder is arranged between the contactors, and wherein the contactors each include one front face and one rear face, opposite the front face, and wherein the rear faces and the blocking element holder end flush with one another.

17. A contactor arrangement, comprising:

two contactors including guides; and blocking means for, in an intermediate position, permitting operation of either contactor when none of the contactors are operated, and for, in a blocking position deflected from the intermediate position, blocking operation of one of the two contactors, thereby creating a blocked contactor, upon one of the contactors being operated, the blocking position preventing operation of the blocked contactor, wherein the guide of the blocked contactor acts in an operating region on the blocking means upon attempting to operate the blocked contactor, wherein the guides act directly on the blocking means, wherein essentially only compression forces occur in the blocking means as a result of an attempt to operate the blocked contactor wherein side surfaces of the contactors face one another, wherein the blocking means is arranged in a blocking element holder, wherein the blocking element holder is arranged between the contactors, and wherein the blocking element holder is arranged at least partially recessed in the contactors.

18. The contactor arrangement as claimed in claim 17, wherein the blocking means is pivotable in a pivoting plane which runs at right angles to side surfaces of the contactors.

19. A contactor arrangement, comprising:

two contactors including guides; and blocking means for, in an intermediate position, permitting operation of either contactor when none of the contactors are operated, and for, in a blocking position deflected from the intermediate position, blocking operation of one of the two contactors, thereby creating a blocked contactor, upon one of the contactors being operated, the blocking position preventing operation of the blocked contactor, wherein the guide of the blocked contactor acts in an operating region on the blocking means upon attempting to operate the blocked contactor, wherein the guides act directly on the blocking means, wherein essentially only compression forces occur in the blocking means as a result of an attempt to operate the blocked contactor, wherein side surfaces of the contactors face one another, wherein the blocking means is arranged in a blocking element holder, wherein the blocking element holder is arranged between the contactors, wherein the contactors each include one front face and one rear face, opposite the front face, and wherein the rear faces and the blocking element holder end flush with one another.

* * * * *